United States Patent [19]

Burch

[11] 4,378,635

[45] Apr. 5, 1983

[54] HAIR TRIMMING DEVICE

[76] Inventor: Lorraine Burch, 3813 Blaine, Detroit, Mich. 48206

[21] Appl. No.: 180,029

[22] Filed: Aug. 21, 1980

[51] Int. Cl.[3] ..... B26B 21/10

[52] U.S. Cl. ..... 30/58; 30/330

[58] Field of Search ..... 30/32, 58, 330, 331

[56] References Cited

U.S. PATENT DOCUMENTS

| | | | |
|---|---|---|---|
| D. 199,242 | 9/1964 | Mauro | D28/45 |
| 1,548,139 | 8/1925 | Grimm | 30/332 |
| 1,743,607 | 1/1930 | Johnson | 30/330 |
| 2,001,198 | 5/1935 | Klegman | 30/58 |
| 2,426,117 | 8/1947 | Ostrovsky | 30/58 X |
| 2,715,770 | 8/1955 | Meyer | 30/330 |
| 2,972,187 | 2/1961 | Gore | 30/330 X |
| 3,031,756 | 5/1962 | Epifanio | 30/58 |

*Primary Examiner*—Jimmy C. Peters

*Attorney, Agent, or Firm*—Irving M. Weiner; Pamela S. Burt; John L. Shortley

[57] ABSTRACT

A hair trimming device for moustaches and eyebrows which has a replaceable blade. The blade is held between a pair of plates. The blade is curved to provide a perfect cut, and the plates are likewise curved. The plates are hinged and can be quickly swung from open to close position and simple means are provided for locking the blades in position. In one form, a handle receives a flexible connector which is fastened to the blade supporting plate. The flexible connector can be moved along the handle to a position in which the plates are taughtly held against the handle and the blade is securely positioned between the plates. When moved in the opposite direction, the flexible member can be flexed to permit opening of the plates and replacement of the blade.

11 Claims, 15 Drawing Figures

HAIR TRIMMING DEVICE

This invention relates to tonsorial equipment and in particular pertains to a device for close and accurate trimming of hair such as found in eyebrows and moustaches.

BACKGROUND OF THE INVENTION

1. Field of the Invention

Hair trimming is an art that has over the years spawned many developments in cutting and trimming devices for various purposes. Special shears, clippers, trimmers and the like, employing blades of the scissors type, as well as those of the thin sheet type, such as used in safety razors, have been developed. The instant invention relates to an instrument especially designed for precise trimming of brows and moustaches. The invention employs a removable blade and a holder having means fixing the replaceable blade which presents a smooth exterior surface and is unincumbered by nuts or other fastening devices. The clean design of the blade holding portion enables the stylist to closely sweep the instrument adjacent the comb which may be used with it in performing the trimming operation, also the instrument may be swept closely to the skin of the customer without danger of abrasion from projecting portions.

2. Summary of the Invention

The present invention provides a hair trimming device particularly for use in trimming eyebrows and moustaches which comprises a handle. The handle supports a blade-like cutting member in a blade support. A flexible connection link extends along the handle. There is means for alternately extending and retracting the connection link along the handle and the link is fixedly connected to the blade support. The length of the link is such that a blade support is pulled firmly into contact with the handle when the link is retracted along the handle and the blade-like member is then held in trimming position with respect to the handle.

According to the invention the handle has a hollow core and the extendable and retractable connection link is recessed within the core. The link extends outwardly from the end of the handle into engagement with the blade support. When the link is moved upwardly along the handle the blade support can be opened for removal and replacement of the blade-like cutting member. When the link is moved downwardly the plate support with the blade in place is pulled into contact with the handle and held there in position for use in trimming.

Preferably according to the invention a pair of plates are provided for the blade support with the blade being mounted between the plates. Further, the link is fastened firmly to both plates. The blade support is held firmly against a ledge on the handle when the link is retracted.

A thumb plate is provided for extending and retracting the flexible connection link. There is a lock slot within the handle and the thumb plate can be pushed into the lock slot to hold the blade support in the operative position.

The two blade supporting plates are pivotally connected to each other. The axis of the pivot is substantially perpendicular to the ledge on which the plates are supported when in operative position. The link extends substantially parallel to this axis.

DETAILED DESCRIPTION OF THE PREFERRED EMBODIMENT

Figures 1, 2, 3, 4, 5, 6, 7, 8, 9, 10, 11, 12, 13, 14, 15:
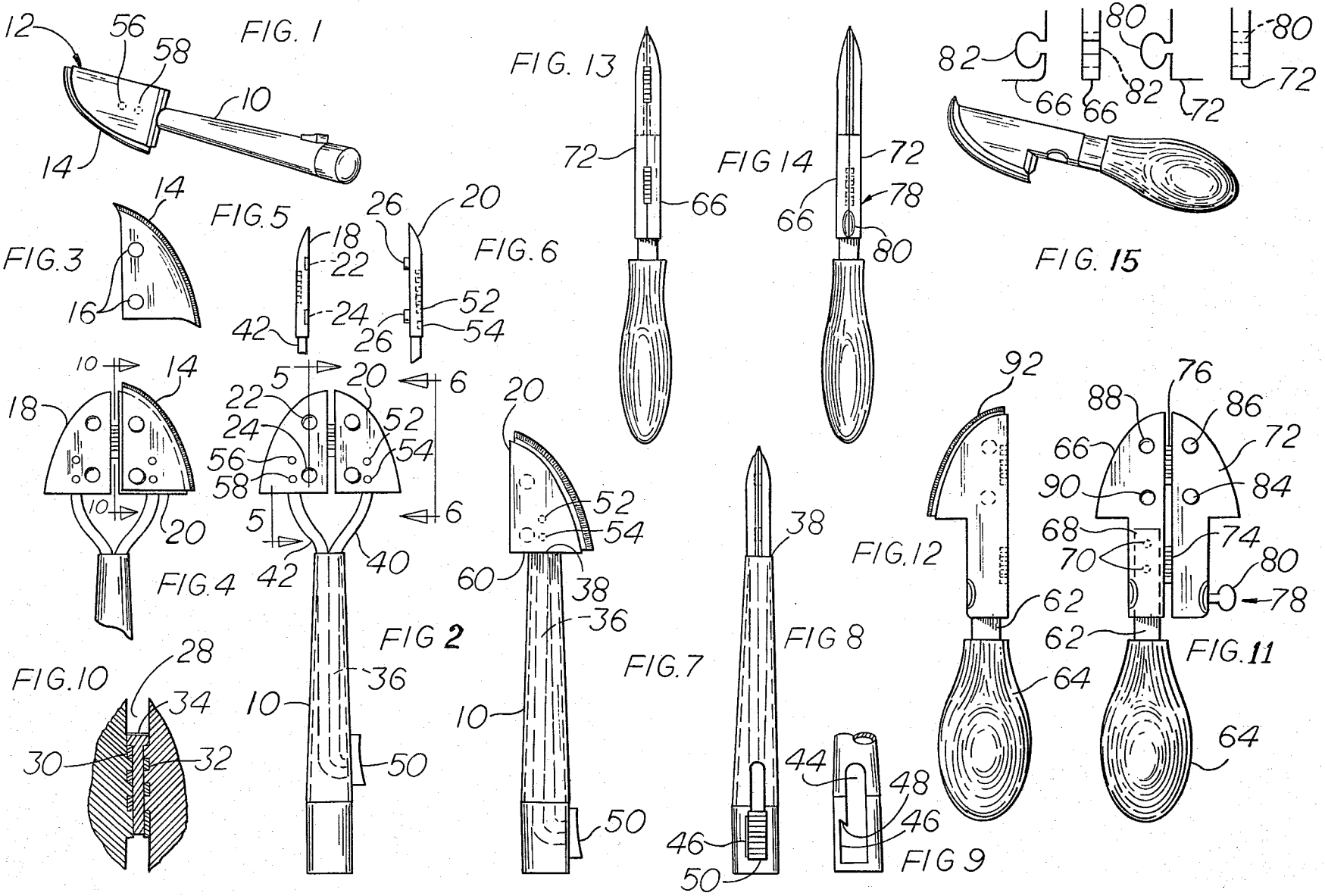
FIG. 1 shows a perspective view of one embodiment of the hair trimming aparatus.
FIG. 2 shows the hair trimming apparatus with the blade holding plates in the open position.
FIG. 3 shows a replaceable blade.
FIG. 4 shows the blade in position on the plates illustrated in FIG. 2.
FIG. 5 is a side view of one of the plates shown in FIGS. 2 and 4.
FIG. 6 is the side elevational view of the second plate shown in FIGS. 2 and 4.
FIG. 7 is a side elevational view showing the blade and plates in the closed position.
FIG. 8 is an end view showing a slot in which a pin slides.
FIG. 9 is a fragmentary side elevational view of the slot shown in FIG. 8.
FIG. 10 is a fragmentary view showing a hinge.
FIG. 11 is a side view of a second embodiment of the invention showing the plates in open position.
FIG. 12 is a view similar to FIG. 11 but showing the plates in closed position and the blade in place.
FIG. 13 is a side elevational view of the instrument shown in FIG. 11 and 12.
FIG. 14 is a view showing the side opposite that shown in FIG. 13.
FIG. 15 is a perspective view of the second form of the invention.

The trimming device shown in FIG. 1 comprises a handle 10. A blade support member 12 is connected to the handle and a blade 14 is received within the blade support. As shown in FIG. 3 the blade 14 has a typical cutting edge and a pair of pin receiving openings 16. The blade is preferably a thin steel member similar in construction to the typical razor blade.

As shown in FIGS. 5 and 6 the blade support is formed by a pair of plates 18 and 20. Plate 18 has a pair of recesses or sockets 22 and 24 whereas plate 20 has a mating pair of anchor pins 26. The pin receiving openings 22 and 24 on blade 18 are adapted to fit over the pins 26, and the pins 26 ae received within the sockets 22 and 24 when the two plates 18 and 20 are closed.

FIGS. 2 and 4 show the plates 18 and 20 in the open condition. FIG. 4 shows the blade 14 in position. As illustrated in FIG. 10 the two plates 18 and 20 are connected by a hinge 28. The hinge comprises links 30 and 32 and a pin 34.

The handle has a hollow core 36 which terminates at an upper ledge 38. A flexible connection link preferably having a pair of strands, 40 and 42, extends through the hollow core upwardly above the ledge 38. One strand is connected to one of the plates 18 and the other to the opposite plate 20, as will be described below.

As illustrated in FIGS. 2, 7, 8 and 9 the handle has a longitudinally extending slot 44 which on the lower end has an enlarged portion 46 which is a lock slot. The lock slot has a section 48 which extends at an angle to the slot 44. A thumb plate 50 which, forms a lock tab, is slidably positioned within the slot 44 and can be moved as shown in FIGS. 8 and 9 into the lock slot 46 to bear against section 48. The thumb plate is connected to the two flexible strands 42 and 44, and by operating the plate 50 the two strands 42 and 44 can be moved upwardly and downwardly in the core of the handle. As shown in FIGS. 2, 6 and 7, pins 52, 54, 56 and 58 connect the flexible links 42 and 44 to the plates 18 and 20 respectively.

The flexible members 42 and 40 are formed to steel fiber of the type employed in automobile tires, and are extremely flexible transversely of their length, but are relatively inextensible. At their upper end, where the pins 52–58 are provided, they are integrated by means of adhesive or welding to form a solid base for the pins. At the lower end likewise they are connected to a lock tab 50 in a similar manner. That is, preferably by adhesive, although welding can be employed. The flexible members 40 and 42 can also be formed of nylon.

The flexible members 40 and 42 are connected to the plates 18 and 20 approximately longitudinally at the mid point of the bases 60 of the plates.

When the flexible strands are in the position shown in FIGS. 2 and 4, the plates 18 and 20 can be swung open to remove or attach a blade 14. With the blade in position the plates are closed and then the flexible members are moved down into the handle by manipulation of the thumb plate 50. When the bases 60 abut the ledge 38 the plates are held in the position shown in FIG. 7 by frictional contact between the bases 60 and the ledge 38. The trimmer can now be used for trimming eyebrows and moustaches.

FIGS. 11–15 show a second form of the invention. In this instance the handle 62 has a palm fitting section 64. Plate 66 is secured to the stem 68 by pins 70 although an adhesive can be used either alone or in conjunction with such pins. A second plate 72 is connected to plate 66 by hinges 74 and 76. A lock 78 is provided by means of a keeper 80 and a keeper slot 82.

Pins 84 and 86 and sockets 88 and 90 are utilized to hold the blade 92.

It is apparent that a simple instrument is provided which can be readily opened to remove and replace blades, but which also can be quickly swung back into operative position. Furthermore, there is a minimum of projecting surfaces on the plates 18 and 20. There are no projecting bolts, and nuts which must be screwed to hold the blades in position, and which would in many instances interfere with the use of the device in trimming. While pins 52–56 are shown to be used for connecting the strands 40 and 42 to the plates 18 and 20, an adhesive can be used instead.

The blade and the blade supports are curved within a plane extending longitudinally through the handle. The curved blade provides for better control by the operator than would a straight edge.

Although there have been described what is at present considered to be a preferred embodiments of the invention, it will be understood that the invention may be embodied in other specific forms without departure from the spirit or essential characteristics thereof. The present embodiment is therefore to be considered as illustrative, and not restrictive. The scope of the invention is indicated by the appended claims rather than by the foregoing description.

I claim:

1. A hair trimming device comprising a handle;
a blade-like member;
a blade support;
said blade-like member being mounted on said support;
means for mounting said support on said handle;
said support comprising two plate-like members hingedly connected about a axis parallel to said handle;
means for locking said blade support in association with said handle, with said blade firmly held in said blade support;
a flexible connection link movably extending along said handle;
means for alternately extending and retracting said flexible connection link along said handle;
said flexible connection link being fixedly connected to said plate-like members;
said flexible connection link being flexible transversely of its length;
said handle having a ledge extending transversely of an outer end thereof;
said blade support being urged against and supported upon said ledge with said plate-like members supporting said blade-like member when said connection link is in a first retracted position; and
said flexible connection link being movable to a second position wherein said plate-like members are spaced from said ledge and said flexible connection link projects outwardly from said handle with said flexible connection link being flexible transversely of its length sufficiently for movement of one of said plate-like members relative to the other for insertion of a blade between the latter members.

2. The hair trimming device of claim 1, wherein:
one of said blade support members has pins for receiving said blade and the other has slots for receiving said pins.

3. The hair trimming device of claim 1, wherein:
said blade and said blade supports are curved within a plane receiving said handle.

4. The trimming device of claim 1, wherein:
said means for extending and withdrawing said link comprises a thumb plate connected to said link extending outwardly of said handle;
means forming a slot within which said thumb plate is movable.

5. The hair trimming device of anyone of claims 1, 2 or 3, wherein:
said handle has a hollow core and said flexible connection link extends within said core.

6. A hair trimming device comprising a handle:
a handle-like member;
a flexible connection link movably extending along said handle;
means for alternately extending and retracting said connection link along said handle;
a blade support;
said blade-like member being mounted on said support;
said link being fixedly connected to said blade support;
said link being of a length such that said blade support is pulled firmly into contact with a ledge on said handle when said link is retracted along said handle with said blade-like member being held in trimming position with respect to said handle;
said blade support comprising a pair of plates;
means fixing said blade in said plates;
said plates being pivotably connected with said link being connected to both said plates;
said plates being held in opposition to one another with said blade being supported therebetween when said plates are urged against said handle by said link;

said link being adapted to firmly draw both said plates against said ledge on said handle, with said blade firmly held between said plates.

7. The trimming device of claim 6, wherein:

said link comprises two strands, one being connected to one of said plates and the other to the other of said plates.

8. The trimming device of claim 6, wherein:

said plates are pivotably connected to each other about an axis extending perpendicularly to said ledge on said handle contacted by said plates and said link extends substantially parallel to said axis at said ledge.

9. The trimming device of claim 6, wherein:

said plates comprise anchor pins for fixing said blade.

10. A hair trimming device comprising a handle;

a blade-like member; ;p0 a flexible connection link movably extending along said handle;

means for alternately extending and retracting said connection link along said handle;

a blade support;

said blade-like member being mounted on said support;

said link being fixedly connected to said blade support;

said link being of a length such that said blade support is pulled firmly into contact with a ledge on said handle when said link is retracted along said handle with said blade-like member being held in trimming position with respect to said handle;

said means for extending and withdrawing said link comprising a thumb plate connected to said link extending outwardly of said handle;

means forming a slot within which said thumb plate is movable; and a lock section within said slot for receiving said thumb plate to lock said plates in closed position against said handle.

11. The trimming device of claim 10, wherein:

said handle has a ledge against which said thumb plate bares when in locked position.

* * * * *